US006267557B1

(12) United States Patent
Chin

(10) Patent No.: US 6,267,557 B1
(45) Date of Patent: Jul. 31, 2001

(54) AEROFOIL BLADE DAMPER

(75) Inventor: Kevin Chin, Houston, TX (US)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/438,982

(22) Filed: Nov. 12, 1999

(51) Int. Cl.[7] ..... F01D 5/10
(52) U.S. Cl. ..... 416/190; 416/223 R
(58) Field of Search ..... 416/190, 204, 416/223 R, 229 R, 229 A, 238

(56) References Cited

U.S. PATENT DOCUMENTS

| | | | | |
|---|---|---|---|---|
| 4,101,245 | * | 7/1978 | Hess et al. | 416/190 |
| 4,516,910 | * | 5/1985 | Bouiller et al. | 416/190 |
| 4,655,687 | * | 4/1987 | Atkinson | 416/190 |
| 4,917,574 | * | 4/1990 | Dodd et al. | 416/190 |
| 5,143,517 | * | 9/1992 | Vermont | 416/190 |
| 5,573,375 | * | 11/1996 | Barcza | 416/190 |

FOREIGN PATENT DOCUMENTS

| | | |
|---|---|---|
| 996729 | 6/1965 | (GB) . |
| 1259750 | 1/1972 | (GB) . |
| 1410607 | 10/1975 | (GB) . |
| 2112466 | 7/1983 | (GB) . |

* cited by examiner

*Primary Examiner*—F. Daniel Lopez
*Assistant Examiner*—James M. McAleenan
(74) *Attorney, Agent, or Firm*—W. Warren Taltavull; Manelli, Denison & Selter PLLC

(57) ABSTRACT

A damping member (27) for positioning between the undersides of the platforms of adjacent turbine blades (20) and the peripheral surface of a disc (19) upon which the turbine blades (20) are mounted. The damping member (27) comprises first, second and third portions (28,31 and 32). The first portion (28) simultaneously engages the adjacent blade platforms (24) whereas the second and third portions (31,32) converge to engage each other at the disc (19) peripheral surface from a spaced apart relationship with each other at their attachment to the first portion (28). Frictional interaction between the second and third portions (31,32) and the disc (19) peripheral surface provides damping of turbine blade (20) vibration.

9 Claims, 2 Drawing Sheets

Fig.1.
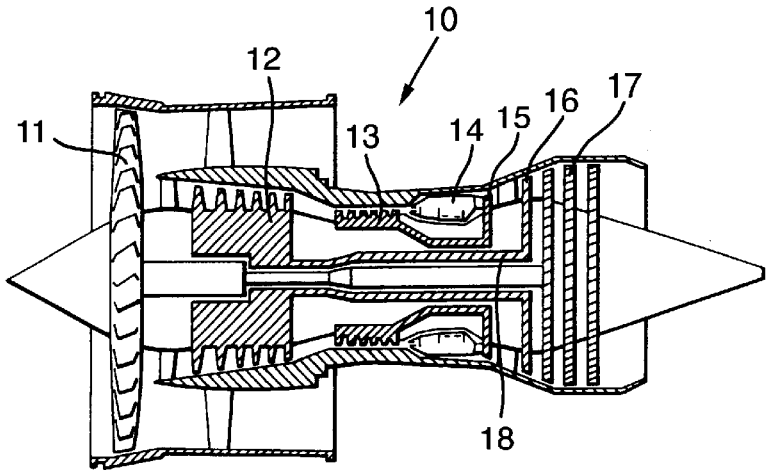
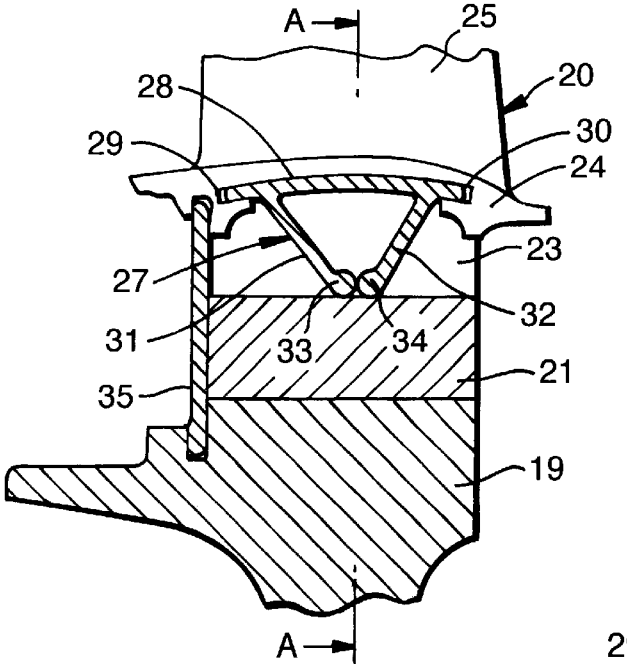
Fig.2.
Fig.5.
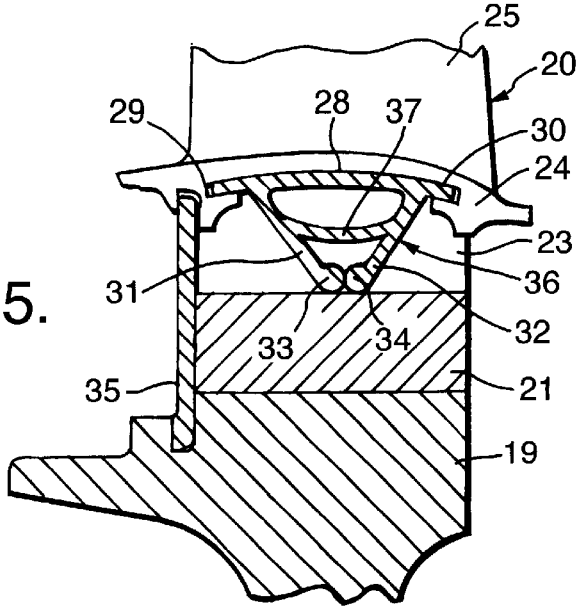

AEROFOIL BLADE DAMPER

This invention relates to a damper for aerofoil blades and in particular a damper for aerofoil blades mounted on a rotatable disc.

Gas turbine engines for aircraft, marine and land use typically have axial flow turbines that comprise a number rotatable discs, each of which carries an annular array of radially extending aerofoil blades on its periphery. Each aerofoil blade is provided with a root portion by means of which it is attached to its associated disc, and a platform positioned between its aerofoil portion and root portion. While such a method of attachment is effective in ensuring the integrity of each blade/disc assembly, problems can still arise as a result of aerofoil blade vibration. Aerofoil blades commonly vibrate in both flap and torsional modes. In the torsional mode of vibration, each aerofoil blade tends to twist about its longitudinal axis whereas in the flap mode, each aerofoil blade flaps in a generally circumferential direction.

It is well known to combat flap and torsional modes of aerofoil blade vibration by the provision of damping members that are configured and positioned so that one damping member spans the undersides of the platforms of circumferentially adjacent aerofoil blades. Centrifugal loading due to disc rotation urges the damping members into engagement with the platform undersides. Damping is provided by frictional interaction between the dampers and blade platforms.

While such damper members are effective in damping torsional and flap modes of vibration, they are less effective in dealing with edgewise modes of vibration. Edgewise modes of vibration are characterised by bending of each aerofoil blade in forward and rearward directions (with respect to the axis of rotation of the disc on which the aerofoil blades are mounted).

It is an object of the present invention to provide an aerofoil blade damper which is so configured as to provide effective damping of edgewise modes of aerofoil blade vibration.

According to the present invention, a damping member for damping vibration of aerofoil blades mounted on a rotary disc, which aerofoil blades are provided with platforms in radially spaced apart relationship with said disc, comprises a first portion for operationally and simultaneously engaging the platforms of a pair of circumferentially adjacent aerofoil blades, and second and third portions extending from said first portion for operationally engaging a peripheral surface on said disc, said second and third portions converging from a spaced apart relationship with each other at said first portion into operational engagement with each other adjacent said disc peripheral surface.

Frictional interaction between the second and third portions, and between the disc peripheral surface and the second and third portions give rise to the damping of edgewise modes of aerofoil blade vibration.

Said second and third portions are preferably formed from sheet material.

Said sheet material may be metallic.

Said first, second and third portions may be integral.

Said second and third portions may be of curved cross-section configuration at their region of contact with each other and with disc peripheral surface.

A fourth portion may be provided to interconnect said second and third portions intermediate the extents of said second and third portions.

Said fourth portion may be formed from sheet material and be of curved cross-sectional configuration.

Said first position is preferably of generally cylindrical configuration.

The present invention will now be described, by way of example, with reference to the accompanying drawings in which:

FIG. 1 is a schematic sectioned side view of a ducted fan gas turbine engine having a plurality of damping members in accordance with the present invention.

FIG. 2 is a sectioned side view of a portion of one of the turbine discs/aerofoil blade assemblies of the ducted fan gas turbine engine shown in FIG. 1 which is provided with a damping member in accordance with the present invention.

FIG. 5 is a view similar to that shown in FIG. 2 of an alternative embodiment of the present invention.

Figure 3:
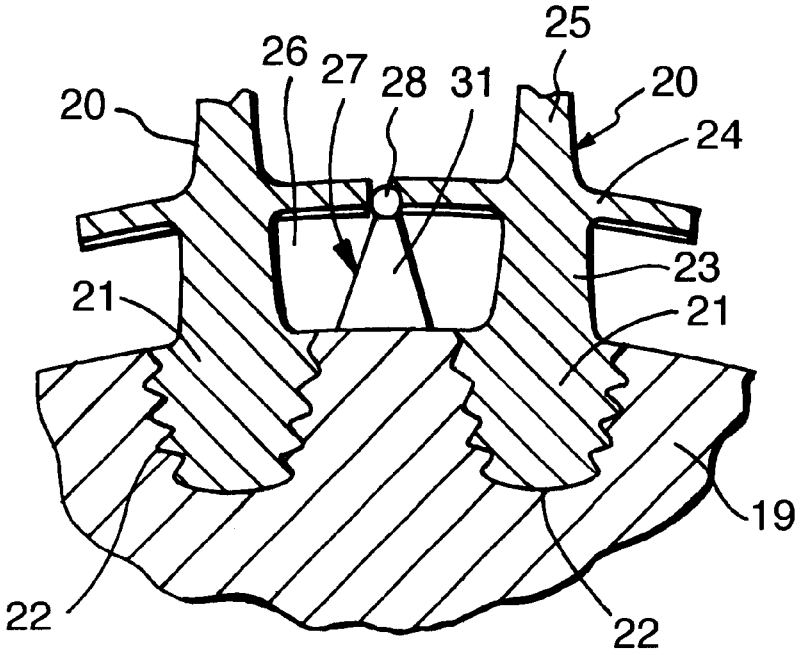
FIG. 3 is a view on section line A—A of FIG. 2.

With reference to FIG. 1 a ducted fan gas turbine engine generally indicated at 10 is of conventional configuration comprising, in axial flow series, a fan 11, intermediate pressure compressor 12, high pressure compressor 13, combustion equipment 14, high pressure turbine 15, intermediate pressure turbine 16 and a low pressure turbine 17.

The engine 10 functions in the conventional manner whereby some of the air exhausted from the fan 11 is compressed in the intermediate and high pressure compressors 12 and 13 before being mixed with fuel in the combustion equipment 14 and the mixture combusted. The resultant combustion products then expand through, and thereby drive, the high, intermediate and low pressure turbines 15, 16 and 17 before being exhausted to atmosphere to provide propulsive thrust. The remainder of the air exhausted from the fan 11 provides additional propulsive thrust.

The intermediate pressure turbine 16 serves to drive the intermediate pressure compressor 12 via a shaft 18. If reference is now made to FIGS. 2 and 3, it will be seen that it comprises a conventional disc 19 that rotates with the shaft 18. The peripheral region of the disc 19 carries an annular array of similar radially extending aerofoil blades 20. Each aerofoil blade 20 comprises a fir tree cross-section configuration root portion 21 that enables it to locate in a correspondingly shaped slot 22 provided in the disc 19 peripheral region. Such fir tree configuration roots are well known and serve to provide effective radial fixing of each aerofoil blade 20 on the disc 19.

Each aerofoil blade 20 additionally comprises a shank portion 23 extending from the root portion 21, a platform 24 and an aerofoil cross-section portion 25, the platform 24 being interposed between the aerofoil portion 25 and the shank portion 23. The aerofoil portions 25 are located in the annular gas passage through which combustion products pass following their exhaustion from the combustion equipment 14. Part of the radially inner boundary of that gas passage is defined by the blade platforms 24 co-operating to define a generally annular surface, although small circumferential gaps are provided between adjacent platforms for thermal expansion purposes. The axial leakage of gas between the disc 19 and aerofoil blades 20 is inhibited in the conventional manner by an annular array of seal plates 35 that are interposed between the blade platforms 24 and the disk 19.

As the combustion gases exhausted from the combustion equipment pass over the aerofoil portions 25 of the aerofoil blades 20 they tend to induce vibration in those blades 20.

Under certain operating conditions, each of the aerofoil blades 20 vibrates in an edgewise mode. Thus each blade 20 tends to rock forwards and backwards with respect to the longitudinal axis of the engine 10 and, in turn, the axis of the disc 19 upon which it is mounted.

Such edgewise vibration is undesirable in that it can ultimately result in damage to the blades 20.

The present invention is particularly concerned with damping members 25 that are interposed between the blade platforms 24 and the disc 19 to inhibit such vibration. More specifically, one damping member 27 is located in a space 26 defined by part of the peripheral surface of the disc 19 and the shanks 23 and platforms 24 of circumferentially adjacent blades 20 as can be seen most clearly in FIG. 3.

Each damping member 27 comprises a first portion 28 that is in the form of a cylindrical piece of metal curved in the axial direction as can be seen in FIG. 2. The first damping member portion 28 engages the circumferential extents of adjacent blade platforms 24 simultaneously as can be seen most clearly in FIGS. 3 and 4. While one of the blade platforms 24 engaging the first damping member portion 28 is flat, the other, as can be seen most clearly in FIG. 4, is shaped to extend part way around the first damping member portion 28. This is to ensure radial retention of each damping member 27 under centrifugal loading.

The first damping member portion 28 is retained in position axially relative to the blade platforms 24 by virtue of its location in circumferentially extending slots 29 and 30 provided in the axial extents of adjacent blade platforms 24.

Each first damping member portion 28 is provided on it radially inner surface with second and third portions 31 and 32. The second and third portions 31 and 32 are formed from sheet metal and are integral with the first portion 28. They are axially spaced apart from each other at their positions of attachment to the first portion and are generally circumferentially extending. However, they converge in a generally radially inward direction when viewed in a circumferential direction until they engage each other at the peripheral surface of the disc 19. As can be seen in FIG. 2 the radially inward abutting edges 33 and 34 of the second and third portions 31 and 32 respectively are of rounded cross-sectional configuration.

Figure 4:
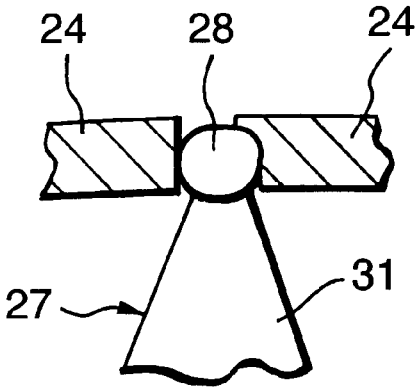
FIG. 4 is a view on an enlarged scale of a portion of the view shown in FIG. 3.

Additionally, as can be seen in FIG. 3, the second and third portions 31 and 32 diverge in a radially inward direction when viewed in an axial direction, so providing stability at their positions of engagement with the peripheral surface of the disc 19.

The dimensions of the second and third portions 31 and 32 are such that when the damping member 27 is in its operative position as shown in FIGS. 2 and 3, the engagement of the second and third portions 31 and 32 with each other and with the peripheral surface of the disc 19 results in those second and third portions 31 and 32 being pre-stressed. Thus, each damping member 27 is effectively wedged between the peripheral surface of the disc 19 and a pair of adjacent blade platforms 24.

During the operation of the ducted fan gas turbine engine 10, the disc 19 rotates at high speed. Each of the damping members 27 is, as a result, a centrifugally loaded. This centrifugal loading causes the second and third components 31 and 32 to be urged towards each other. However, this is resisted by virtue of the engagement of the second and third components 31 and 32 with each other at their radially inner edges 33 and 34. It will be seen, therefore, that each of the second and third components 31 and 32 inhibits the other from bending in a radially outward direction under the influence of centrifugal loading. Consequently the engagement of the second and third components 31 and 32 with each other ensures that they additionally remain in contact with the peripheral surface of the disc 19.

If the aerofoil blades 20 are subject to edgewise vibration as described earlier, they tend to rock in an axial direction. This in turn leads to the damping members 27 also being subjected to that rocking motion. However, the frictional interaction between the second and third damping member portions 31 and 32 with the peripheral surface of the disc 19 ensures that there is resistance to that rocking motion. Thus that rocking motion is damped. Additionally, since such rocking motion gives rise to relative movement between the rounded edges 33 and 34 of the second and third portions 31 and 32, then the frictional interaction between them provides further damping of the rocking motion of the aerofoil blades 20. Additionally, if there is any flap-wise vibration of the aerofoil blades 20, then this too will be damped by the damping members 27.

As the rotational speed of the disc 19 increases, so does the centrifugal loading imposed upon the damping members 27. This in turn increases the reaction between the second and third components 31 and 32, thereby increasing in turn their damping effectiveness.

In addition to providing damping of the aerofoil blades 20, the engagement between the damping members 27 and the platforms 24 serves to inhibit gas leakage through the small expansion gaps that exist between the platforms 24. Inhibition of this gas leakage is an important factor in ensuring the efficient operation of the intermediate pressure turbine 16.

In a further embodiment of the present invention shown in FIG. 5, a modified damping member 36 in accordance with the present invention is provided. Most of the features of the modified damping member 36 correspond with those of the previously described embodiment of FIGS. 2, 3 and 4 and are numbered accordingly. However, it is provided with a curved metal sheet 37 that interconnects the second and third portions 31 and 32 at approximately halfway along their radial extents. When the damping member 36 is in position between the blade platforms 24 and the disk 19, the curved sheet 37 is pre-sprung to resist distortion of the second and third damping member portions 31 and 32 under centrifugal loading. This ensures that the damping action of the damping member 36 is not degraded as a result of the second and third portions 31 and 32 lifting off the surface of the disc 19.

Although the present invention has been described with reference to the damping of intermediate pressure turbine blades, it will be appreciated that it could also be utilised in the damping of other turbine blades.

What is claimed is:

1. A damping member for damping vibration of aerofoil blades mounted on a rotary disc, which aerofoil blades are provided with platforms in radially spaced apart relationship with said disc, comprising a first portion for operationally and simultaneously engaging the platforms of a pair of circumferentially adjacent aerofoil blades, and second and third portions extending from said first portion for operationally engaging a peripheral surface on said disc, said second and third portions converging from a spaced apart relationship with each other at said first portion into operational engagement with each other adjacent said disc peripheral surface.

2. A damping member as claimed in claim 1 wherein said second and third portions are formed from sheet material.

3. A damping member as claimed in claim 2 wherein said sheet material is metallic.

4. A damping member as claimed in claim 1 wherein said first, second and third portions are integral.

5. A damping member as claimed in claim 1 wherein said second and third portions are of curved cross-section configuration at their region of contact with each other and with disc peripheral surface.

6. A damping member as claimed in claim 1 wherein a fourth portion is provided to interconnect said second and third portions intermediate the extents of said second and third portions.

7. A damping member as claimed in claim 6 wherein said fourth portion is formed from sheet material and is of curved cross-sectional configuration.

8. A damping member as claimed in claim 1 wherein said first portion thereof is of generally cylindrical configuration.

9. A damping member as claimed in claim 1 further including a bladed rotor for a gas turbine engine having said rotary disc carrying an annular array of said aerofoil blades, each of said platforms of said blades extend circumferentially in spaced apart relationship with said disk, said damping member being interposed between adjacent platforms and the peripheral surface of said disk.

* * * * *